US006389761B1

(12) United States Patent
McKinnon

(10) Patent No.: US 6,389,761 B1
(45) Date of Patent: May 21, 2002

(54) EARTHQUAKE RESISTANT SUPPORT STRUCTURE

(76) Inventor: Ian McKinnon, 1326 Amberwood Dr., Woodstock, GA (US) 30189

( * ) Notice: Subject to any disclaimer, the term of this patent is extended or adjusted under 35 U.S.C. 154(b) by 0 days.

(21) Appl. No.: 09/572,804

(22) Filed: May 17, 2000

Related U.S. Application Data

(63) Continuation of application No. 09/012,658, filed on Jan. 23, 1998, now abandoned.

(51) Int. Cl.[7] ..... E02D 1/92

(52) U.S. Cl. ..... 52/167.3; 52/167.1; 52/79.1; 52/79.12

(58) Field of Search ..... 52/167.3, 167.1, 52/79.1, 79.9, DIG. 11, 79.12, 731.1, 732.1

(56) References Cited

U.S. PATENT DOCUMENTS 5,090,166 A * 2/1992 Johnson et al. ..... 52/167 CB
5,402,608 A * 4/1995 Chu ..... 52/79.1
5,473,845 A * 12/1995 Livingston et al. ..... 52/79.9
5,600,923 A * 2/1997 Riley ..... 52/79.9
5,956,907 A * 9/1999 Martin ..... 52/169.1

* cited by examiner

*Primary Examiner*—Carl D. Freidman
*Assistant Examiner*—Jennifer I. Thissell
(74) *Attorney, Agent, or Firm*—Goldstein Law Offices P.C.

(57) ABSTRACT

An earthquake resistant support structure for an existing residential room comprises four corner members anchored to each of the wall surfaces at each of the vertical corners within the room and four straight bars mounted between the corner members for preventing the walls from forcibly breaking apart during an earthquake. The earthquake resistant support structure further comprises a pair of cables extending diagonally between the opposite corner members for protecting occupants of the room from falling ceiling that might be generated during an earthquake. When the earthquake resistant support structure is properly incorporated into every room within a building, the system of support structures add strength to the existing framework of the building, thereby preventing severe cracking or falling or walls and ceilings during an earthquake.

1 Claim, 2 Drawing Sheets

10
26
72
24
26
28
18
20
12
12
14T
16
18
22
12
22
14
20
70
22
20
14B

EARTHQUAKE RESISTANT SUPPORT STRUCTURE

CROSS REFERENCES AND RELATED SUBJECT MATTER

The invention is a continuation and relates to subject matter contained in patent application Ser. No. 09/012,658, filed in the United States Patent and Trademark Office on Jan. 23, 1998, now Abandoned.

BACKGROUND OF THE INVENTION

This invention relates to an earthquake resistant support structure for an existing residential room. More particularly, the invention relates to a support structure which employs corner members anchored to each of the vertical corners of a room, straight bars mounted between the corner members, and a pair of cables extending diagonally between the corner members designed to protect occupants of the room during an earthquake.

An ordinary framework of many residential houses and apartments has proven inadequate to withstand the forces from earthquakes. Consequently, many residential houses and apartments are damaged by random motions generated during an earthquake which may cause severe cracking or collapsing of walls and ceilings. The collapse of buildings is responsible for most of the property damage and loss of life during an earthquake. The destructive forces of an earthquake not only leaves behind damaged property and loss of life but also leaves behind psychological scars to those individuals who experience it. They are frightened by the possibility of another earthquake striking, and as a result, often have trouble sleeping inside their house. Thus, it is desirable to have a support structure that can be easily installed into an existing residential room, and at the same time, provide the occupants of the room with an assurance that the additional support provided by the support structure will prevent the walls from breaking apart and the ceiling from collapsing during an earthquake.

A variety of different devices has been designed for withstanding forces from earthquakes. For example, U.S. Pat. No. 4,735,028 to Bouchon discloses an earthquake-resistant partition for sealing an opening formed in a wall of a room containing radioactive material. Likewise, U.S. Pat. No. 5,331,786 to Lippert discloses an earthquake brace for a residential garage front wall to stiffen the wall against wind or earthquake. U.S. Pat. No. 5,354,126 to Pedrego discloses an earthquake-resistant protective enclosure for a human being which is constructed as an integral part of a desk or table.

Despite all these earthquake protective devices, there is still a further need to provide an improved earthquake resistant support structure. Such an earthquake resistant support structure can be readily incorporated into an existing residential room. Moreover, such an earthquake resistant support structure, when properly installed, should sufficiently strengthen the existing framework of the building so as to allow the building to resist a wide range of forces that the building may experience during an earthquake.

While these units mentioned above may be suitable for the particular purpose employed, or for general use, they would not be as suitable for the purposes of the present invention as disclosed hereafter.

SUMMARY OF THE INVENTION

It is an object of the invention to provide an earthquake resistant support structure which can be readily incorporated into an existing residential room.

It is another object of the invention to provide an earthquake resistant support structure which provide the occupants of the room with an assurance that the additional support provided the support structure will prevent the walls from breaking apart and the ceiling from collapsing during an earthquake.

It is yet another object of the invention to provide an earthquake resistant support structure which is capable of sufficiently strengthening the existing framework of the building so as to allow the building to resist a wide range of forces that the building may experience during an earthquake.

The invention is an earthquake resistant support structure for an existing residential room comprising four corner members anchored to each of the vertical corners of the interior of the room and four straight bars mounted between the corner members for preventing the walls from forcibly breaking apart during an earthquake. The earthquake resistant support structure further comprises a pair of cables extending diagonally between the opposite corner members for protecting occupants of the room from falling ceiling that might be generated during an earthquake. When the earthquake resistant support structure is properly incorporated into every room within a building, the system of support structure adds strength to the existing framework of the building, thereby preventing severe cracking or falling or walls and ceilings during an earthquake.

To the accomplishment of the above, and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
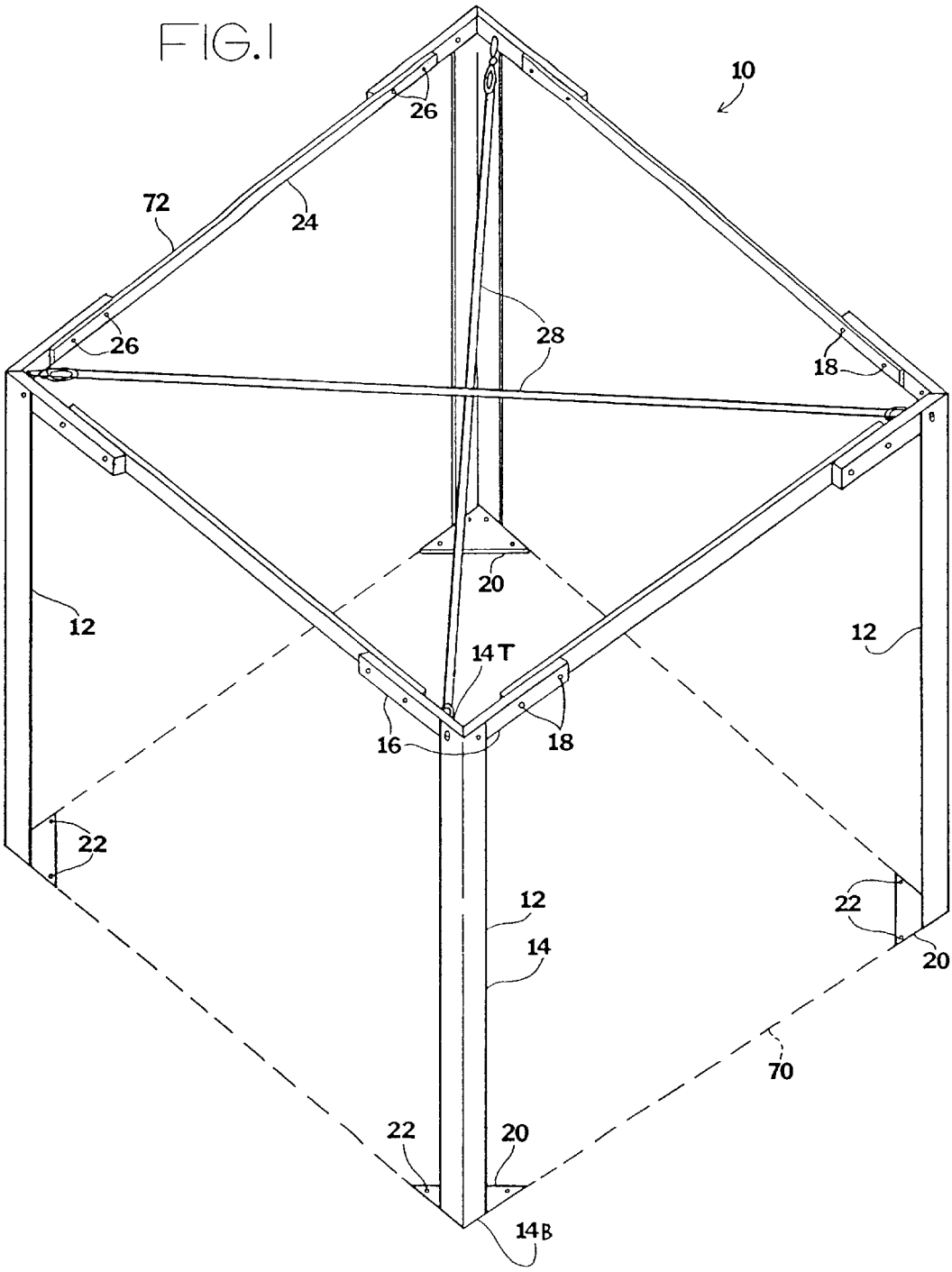
FIG. 1 is a diagrammatic perspective view of a room having an earthquake resistant support structure of the present invention incorporated therein.

FIG. 1 illustrates a room incorporating the principles of a preferred embodiment of an earthquake resistant support structure 10. For a better understanding of the present invention, the room is illustrated consisting generally of four walls, four vertical corners, a floor 70, and a ceiling 72. According to the present invention, the earthquake resistant structure is mounted entirely within the room. The dotted lines represent the inner surface of the floor, walls, and ceiling. That is, the room is defined as the interior volume extending between the outermost wall and ceiling covering (typically sheetrock), as well as the uppermost flooring material. Thus, all components of the earthquake resistant structure mount entirely within the room as defined above. Because the system is retrofit onto existing structure, no components are mounted within the walls, integrated with the building framing. Such mounting would require drastic remodeling which would not meet the purposes of the present invention. The only items which actually penetrate the building structure are the bolts and other fasteners used to fasten the various components of the system to the walls, floor, and ceiling, as appropriate.

The earthquake resistant support structure 10 comprises a plurality of corner members 12 which are identical and interchangeable. The corner members 12 are preferably constructed of heavy duty steel and are positioned along each of the vertical corners of the room, against the surface of the walls.

Figure 2:
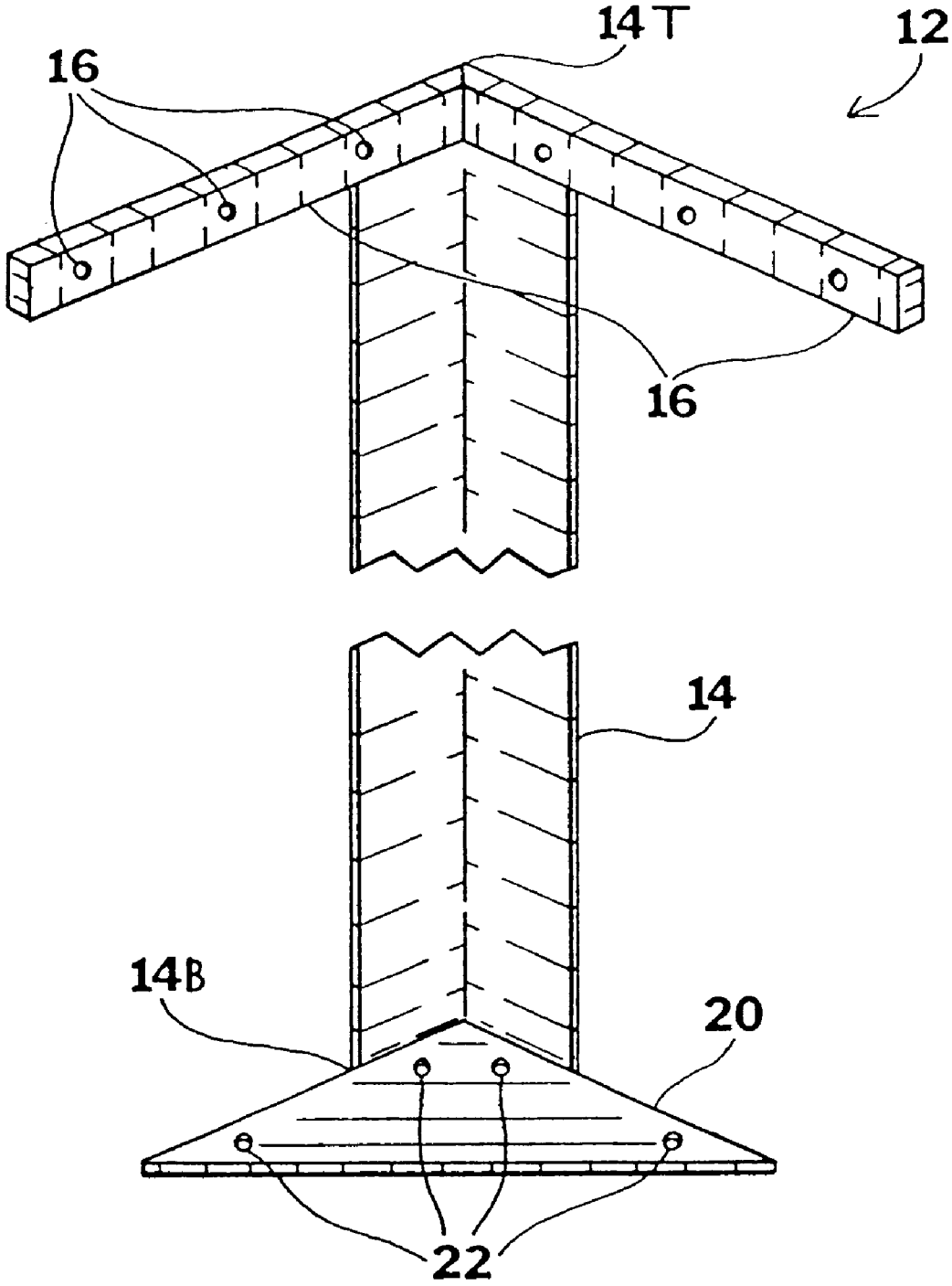
FIG. 2 is a diagrammatic perspective view of the corner member.

Referring to FIG. 2, each corner member 12 includes a vertical column 14 having a top end 14T and a bottom end 14B, the length of which is selected so as to allow the vertical column 14 to extend the entire length between the ceiling 72 and the floor 70. The vertical column 14 is bent at about 90 degrees so as to allow the corner member 12 to lie tightly against the corner. Although in a preferred embodiment, the corner members 12 have vertical columns 14 which are adapted for vertical corners having 90 degrees angle, it should be noted that the shape of the vertical columns 14 may be modified to suit a room with irregular corner angles. Each corner member 12 further includes a pair of horizontally extending arms 16 formed on the top end 14T of the vertical column 14 for securing the top end 14T of the vertical column 14 to the walls adjacent to the ceiling 72. The horizontally extending arms 16 contain at least one horizontally extending arm hole 18 for the passage of affixing fasteners. A triangular steel plate 20 is welded to the bottom end 14B of the vertical column 14 for securely mounting the vertical column 14 to the floor 70. The triangular steel plate 20 has at least one triangular plate hole 22 for the passage of affixing fasteners.

FIG. 1 illustrates the Earthquake resistant support structure further comprising a plurality of straight bars 24 mounted between the corner members 12 for preventing the walls from forcibly breaking apart during an earthquake. The length of each straight bar 24 is preferably substantially similar as the length of the wall to which the straight bar 24 is to be mounted. The straight bars 24 have at least two straight bar holes which are positioned therein such that the straight bar holes 26 align with the horizontally extending arm holes 18.

A pair of cables 28 extends diagonally between the opposite corner members 12 designed to protect residents from falling ceiling debris during an earthquake as viewed in drawing FIG. 1. The pair of cables 28 are supported by four corner members 12 so that if the ceiling 72 should fall onto the pair of cables 28, the forces exerted by the weight of the fallen ceiling are transferred to the four corner members 12 and the straight bars 24 which are firmly secured to the building structural material, thereby preventing the ceiling 72 from falling further.

To incorporate the earthquake resistant support structure 10 into the interior of an existing residential room, the bottom ends 14B of the corner members 12 are first anchored to the corners of the room by affixing fasteners through the triangular plate holes 22 and into the floor 70. The top end 14T of the corner members 12 are securely mounted to the corners adjacent to the ceiling 72 by first aligning the straight bar holes 26 and the horizontally extending arm holes 18, and then affixing fasteners through the holes 26 and 18 and into the wall and the building structural materials behind the wall. After the corner members 12 and the straight bars 24 are properly secured within the room, a pair of cables 28 is affixed between the opposite corner members 12. When the earthquake resistant support structure 10 is properly incorporated into every room within a building, the support structures 10 add strength to the existing framework of the building, thereby preventing severe cracking or falling or walls and ceilings during an earthquake.

While the embodiments of the present invention are disclosed in relation to resisting forces of an earthquake, it will be appreciated by those skilled in the art that the earthquake resistant support structure may also provide protection during a typhoon, tornado, flooding and the like.

Many specific details contained in the above description merely illustrate some preferred embodiments and should not be construed as a limitation on the scope of the invention. Many other variations are possible.

What is claimed is:

1. An earthquake resistant support structure for a room having vertical corners, a ceiling, and a floor, said support structure comprising:

a) a plurality of corner members, said each corner member including a vertical column which has opposite top and bottom ends, a triangular plate secured to the bottom end of said vertical column, and a pair of horizontally extending arms at the top end of the vertical column, said corner members adapted to be anchored to the vertical corners within the room against the walls such that said vertical columns extend between the ceiling and the floor and are adapted to be secured thereto with the horizontal arms and triangular plates, respectively;

b) a plurality of straight bars mounted between the corner members for preventing the walls of the room from forcibly breaking apart during an earthquake; and c) a pair of cables extending diagonally between the opposite corner members for protecting occupants of the room from falling ceiling that might be generated during an earthquake.

* * * * *